US007799148B2

(12) United States Patent
Scott et al.

(10) Patent No.: US 7,799,148 B2
(45) Date of Patent: Sep. 21, 2010

(54) METHOD FOR PRODUCING AUSTENITIC IRON-CARBON-MANGANESE METAL SHEETS, AND SHEETS PRODUCED THEREBY

(75) Inventors: Colin Scott, Montigny les Metz (FR); Philippe Cugy, Thionville (FR); Maurita Roscini, Plesnois (FR); Anne Dez, Plappeville (FR); Dominique Cornette, Volstroff (FR)

(73) Assignee: Arcelor France, Saint Denis (FR)

( * ) Notice: Subject to any disclaimer, the term of this patent is extended or adjusted under 35 U.S.C. 154(b) by 194 days.

(21) Appl. No.: 11/814,329

(22) PCT Filed: Jan. 10, 2006

(86) PCT No.: PCT/FR2006/000043

§ 371 (c)(1),
(2), (4) Date: Sep. 11, 2007

(87) PCT Pub. No.: WO2006/077301

PCT Pub. Date: Jul. 27, 2006

(65) Prior Publication Data

US 2008/0035249 A1 Feb. 14, 2008

(30) Foreign Application Priority Data

Jan. 21, 2005 (FR) ..... 05 00637

(51) Int. Cl.
*C23C 8/22* (2006.01)
*C22C 38/04* (2006.01)
*C21D 8/02* (2006.01)

(52) U.S. Cl. ..... 148/329; 148/319; 148/547; 148/603; 148/620; 148/624; 420/72

(58) Field of Classification Search ..... 148/316–319, 148/328, 329, 333, 337, 603, 619–620, 622, 148/624; 420/72–76
See application file for complete search history.

(56) References Cited

U.S. PATENT DOCUMENTS 6,358,338 B1 * 3/2002 Guelton et al. ..... 148/547
2006/0278309 A1 12/2006 Bouzekri et al.

FOREIGN PATENT DOCUMENTS

| | | | |
|---|---|---|---|
| EP | 1 067 203 | | 1/2001 |
| FR | 2 829 775 | | 3/2003 |
| FR | 2 857 980 | | 1/2005 |
| FR | 2857980 | * | 1/2005 |

OTHER PUBLICATIONS

U.S. Appl. No. 12/373,152, filed Jan. 9, 2009, Scott, et al.
A. Danielou et al., "Fatigue mechanisms in an interstitial free steel: analysis through the behaviour of UHP [alpha]-iron doped with C and Mn" Materials Science and Engineering, vol. A319-321, pp. 550-554, Aug. 27, 2007 XP-002327724.
B.C. DeCooman, "Structure-properties relationship in TRIP steels containing carbide-free bainite", Current Opinion in Solid State and Materials Science vol. 8, pp. 285-303; Jun. 2006.
U.S. Appl. No. 11/720,018, filed May 23, 2007, Cugy, et al.

* cited by examiner

*Primary Examiner*—Scott Kastler
*Assistant Examiner*—Brian Walck
(74) *Attorney, Agent, or Firm*—Oblon, Spivak, McClelland, Maier & Neustadt, L.L.P.

(57) ABSTRACT

Iron-carbon-manganese austenitic steel sheet, the chemical composition of which comprises, the contents being expressed by weight: 0.45%≦C≦0.75%; 15%≦Mn≦26%; Si≦3%; Al≦0.050%; S≦0.030%; P≦0.080%; N≦0.1%; at least one metal element chosen from vanadium, titanium, niobium, chromium and molybdenum, where 0.050%≦V≦0.50%; 0.040%≦Ti≦0.50; 0.070%≦Nb≦0.50%; 0.070%≦Cr≦2%; 0.14%≦Mo≦2%; and, optionally, one or more elements chosen from 0.0005%≦B≦0.003%; Ni≦1%; Cu≦5%, the balance of the composition consisting of iron and inevitable impurities resulting from the smelting, the amounts of said at least one metal element in the form of precipitated carbides, nitrides or carbonitrides being: $0.030\% \leqq V_p \leqq 0.150\%$; $0.030\% \leqq Ti_p \leqq 0.130\%$; $0.040\% \leqq Nb_p \leqq 0.220\%$; $0.070\% \leqq Cr_p \leqq 0.6\%$; $0.14\% \leqq Mo_p \leqq 0.44\%$.

21 Claims, No Drawings

METHOD FOR PRODUCING AUSTENITIC IRON-CARBON-MANGANESE METAL SHEETS, AND SHEETS PRODUCED THEREBY

BACKGROUND OF THE INVENTION

1. Field of the Invention

The invention relates to the manufacture of hot-rolled and cold-rolled sheet from iron-carbon-manganese austenitic steels having very high mechanical properties, and especially a high mechanical strength combined with excellent resistance to delayed cracking.

2. Description of the Related Art

It is known that certain applications, especially in the automotive field, require metal structures to be further lightened and strengthened in the event of an impact, and also good drawability. This requires the use of structural materials that combine a high tensile strength with great deformability. To meet these requirements, patent FR 2 829 775 discloses for example austenitic alloys, having as main elements iron/carbon (up to 2%) and manganese (between 10 and 40%), which can be hot-rolled or cold-rolled and have a strength that may exceed 1200 MPa. The mode of deformation of these steels depends only on the stacking fault energy—for a sufficiently high stacking fault energy, an observed mode of mechanical deformation is by twinning, which results in a high work hardenability. By acting as an obstacle to the propagation of dislocations, the twins help to increase the yield strength. However, when the stacking fault energy exceeds a certain limit, perfect dislocation slip becomes the dominant deformation mechanism and the work hardenability is reduced. The aforementioned patent therefore discloses grades of Fe—C—Mn steel whose stacking fault energy is such that a high work hardenability is observed, combined with a very high mechanical strength.

Now, it is known that the sensitivity to delayed cracking increases with the mechanical strength, in particular after certain cold-forming operations since high residual stresses are liable to remain after deformation. In combination with atomic hydrogen possibly present in the metal, these stresses are liable to result in delayed cracking, that is to say cracking that occurs a certain time after the deformation itself. Hydrogen may progressively build up by diffusion into the crystal lattice defects, such as the matrix/inclusion interfaces, twin boundaries and grain boundaries. It is in the latter defects that hydrogen may become harmful when it reaches a critical concentration after a certain time. This delay results from the residual stress distribution field and from the kinetics of hydrogen diffusion, the hydrogen diffusion coefficient at room temperature being low, more particularly in austenitic structural alloys in which the mean path per second of this element is around 0.03 microns. In addition, hydrogen localized at the grain boundaries weakens their cohesion and favors the appearance of delayed intergranular cracks.

There therefore exists a need to have hot-rolled or cold-rolled steels that exhibit simultaneously a high strength and a high ductility, combined with a very high resistance to delayed fracture.

There is also a need to provide such steels inexpensively, that is to say under manufacturing conditions compatible with the productivity requirements of existing industrial lines, and with acceptable costs for this type of product. It is known in particular that it is possible to significantly reduce the hydrogen content by specific degassing heat treatments. Apart from the additional cost of these treatments, their thermal conditions possibly result in grain coarsening or in cementite precipitation in these steels, often incompatible with the requirements in terms of mechanical properties.

The object of the invention is therefore to provide a hot-rolled or cold-rolled steel sheet or product that is inexpensive to manufacture, has a strength of greater than 900 MPa, an elongation at break of greater than 50%, is particularly suitable for cold forming and has a very high resistance to delayed cracking, without any particular need for a specific degassing heat treatment.

SUMMARY OF THE INVENTION

For this purpose, one subject of the invention is an iron-carbon-manganese austenitic steel sheet, the chemical composition of which comprises, the contents being expressed by weight: $0.45\% \leqq C \leqq 0.75\%$; $15\% \leqq Mn \leqq 26\%$; $Si \leqq 3\%$; $Al \leqq 0.050\%$; $S \leqq 0.030\%$; $P \leqq 0.080\%$; $N \leqq 0.1\%$; at least one metal element chosen from vanadium, titanium, niobium, chromium and molybdenum, where $0.050\% \leqq V \leqq 0.50\%$; $0.040\% \leqq Ti \leqq 0.50\%$; $0.070\% \leqq Nb \leqq 0.50\%$; $0.070\% \leqq Cr \leqq 2\%$; $0.14\% \leqq Mo \leqq 2\%$ and, optionally, one or more elements chosen from $0.0005\% \leqq B \leqq 0.003\%$; $Ni \leqq 1\%$ $Cu \leqq 5\%$, the balance of the composition consisting of iron and inevitable impurities resulting from the smelting, the amounts of metal elements in the form of precipitated carbides, nitrides or carbonitrides being: $0.030\% \leqq V_p \leqq 0.150\%$; $0.030\%$ $Ti_p \leqq 0.130\%$; $0.040\% \leqq Nb_p \leqq 0.220\%$; $0.070\% \leqq Cr_p \leqq 0.6\%$; $0.14\% \leqq Mo_p \leqq 0.44\%$.

Preferably, the composition of the steel comprises: $0.50\% \leqq C \leqq 0.70\%$.

According to a preferred embodiment, the composition of the steel comprises: $17\% \leqq Mn \leqq 24\%$.

According to a preferred embodiment, the composition of the steel comprises $0.070\% \leqq V \leqq 0.40\%$, the amount of vanadium in the form of precipitated carbides, nitrides or carbonitrides being $0.070\% \leqq V_p \leqq 0.140\%$.

Preferably, the composition of the steel comprises $0.060\% \leqq Ti \leqq 0.40\%$, the amount of titanium in the form of precipitated carbides, nitrides or carbonitrides being: $0.060\% \leqq Ti_p \leqq 0.110\%$.

Advantageously, the composition of the steel comprises $0.090\% \leqq Nb \leqq 0.40\%$, the amount of niobium in the form of precipitated carbides, nitrides or carbonitrides being: $0.090\% \leqq Nb_p \leqq 0.200\%$.

Preferably, the composition of the steel comprises $0.20\% \leqq Cr \leqq 1.8\%$, the amount of chromium in the form of precipitated carbides being $0.20\% \leqq Cr_p \leqq 0.5\%$.

Preferably, the composition of the steel comprises $0.20\% \leqq Mo \leqq 1.8\%$, the amount of molybdenum in the form of precipitated carbides being $0.20\% \leqq Mo_p \leqq 0.35\%$.

According to a preferred embodiment, the mean size of said precipitates is between 5 and 25 nanometers, and more preferably between 7 and 20 nanometers.

Advantageously, at least 75% of the population of said precipitates lies in an intragranular position.

Another subject of the invention is a process for manufacturing a cold-rolled sheet made of iron-carbon-manganese austenitic steel, in which a steel, the chemical composition of which comprises, the contents being expressed by weight: $0.45\% \leqq C \leqq 0.75\%$; $15\% \leqq Mn \leqq 26\%$; $Si \leqq 3\%$; $Al \leqq 0.050\%$; $S \leqq 0.030\%$; $P \leqq 0.080\%$; $N \leqq 0.1\%$; at least one metal element chosen from vanadium, titanium, niobium, chromium and molybdenum, where $0.050\% \leqq V \leqq 0.50\%$; $0.040\% \leqq Ti \leqq 0.50\%$; $0.070\% \leqq Nb \leqq 0.50\%$; $0.070\% \leqq Cr \leqq 2\%$; $0.14\% \leqq Mo \leqq 2\%$; and, optionally one or more elements chosen from $0.0005\% \leqq B \leqq 0.003\%$; $Ni \leqq 1\%$; $Cu \leqq 5\%$, the balance of the composition consisting of iron and inevitable impurities resulting from the smelting, is supplied; a semifinished product is cast from this steel; this semifinished product is heated to a temperature of between 1100 and 1300° C.; this semifinished product is hot-rolled with an end-of-rolling temperature of 890° C. or higher; the sheet obtained is coiled at a temperature below 580° C.; the sheet is cold-rolled; and an annealing heat treatment is carried out comprising a heating phase at a heating rate $V_h$, a soak phase at a temperature $T_s$ for a soak time $t_s$, followed by a cooling phase at a cooling rate $V_c$, optionally followed by a soak phase at a temperature $T_u$ for a soak time $t_u$, the parameters $V_h$, $T_s$, $t_s$, $V_c$, $T_u$, $t_u$ being adjusted in order to obtain the amount of precipitated metal elements mentioned above.

According to a preferred method of implementation, the parameters $V_h$, $T_s$, $t_s$, $V_c$, $T_u$, $t_u$ are adjusted in such a way that the mean size of the carbide, nitride or carbonitride precipitates after the annealing is between 5 and 25 nanometers and preferably between 7 and 20 nanometers.

Advantageously, the parameters $V_h$, $T_s$, $t_s$, $V_c$, $T_u$, $t_u$ are adjusted in such a way that at least 75% of the population of the precipitates after the annealing lies in an intragranular position.

In a preferred method of implementation, a steel whose chemical composition includes $0.050\% \leqq V \leqq 0.50\%$ is provided, the semifinished product is hot-rolled with an end-of-rolling temperature of 950° C. or higher, the sheet is coiled at a temperature below 500° C., the sheet is cold-rolled with a reduction ratio of greater than 30%, an annealing heat treatment is carried out with a heating rate $V_h$ of between 2 and 10° C./s, at a temperature $T_s$ of between 700 and 870° C. for a time of between 30 and 180 s, and the sheet is cooled at a rate of between 10 and 50° C./s.

The heating rate $V_h$ is preferably between 3 and 7° C./s.

According to a preferred method of implementation, the soak temperature $T_s$ is between 720 and 850° C.

Advantageously, the semifinished product is cast in the form of slabs or thin strips between counterrotating steel rolls.

Yet another subject of the invention is the use of an austenitic steel sheet described above or manufactured by a process described above, for the manufacture of structural parts, reinforcing parts or external parts, in the automotive field.

Further features and advantages of the invention will become apparent over the course of the description below, which is given by way of example.

After numerous trials, the inventors have demonstrated that the various requirements mentioned above can be met by observing the following conditions:

As regards the chemical composition of the steel, carbon plays a very important role in the formation of the microstructure and the mechanical properties. It increases the stacking fault energy and promotes stability of the austenitic phase. When combined with a manganese content ranging from 15 to 26% by weight, this stability is achieved for a carbon content of 0.45% or higher. However, for a carbon content above 0.75%, it becomes difficult to prevent excessive precipitation of carbides in certain heat cycles during industrial manufacture, which precipitation degrades the ductility.

Preferably, the carbon content is between 0.50 and 0.70% by weight so as to obtain sufficient strength combined with optimum carbide or carbonitride precipitation.

Manganese is also an essential element for increasing the strength, for increasing the stacking fault energy and for stabilizing the austenitic phase. If its content is less than 15%, there is a risk of martensitic phases forming, which very appreciably reduce the deformability. Moreover, when the manganese content is greater than 26%, the ductility at room temperature is degraded. In addition, for cost reasons, it is undesirable for the manganese content to be high. Preferably, the manganese content is between 17 and 24% so as to optimize the stacking fault energy and to prevent the formation of martensite under the effect of a deformation. Moreover, when the manganese content is greater than 24%, the mode of deformation by twinning is less favored than the mode of deformation by perfect dislocation glide.

Aluminum is a particularly effective element for the deoxidation of steel. Like carbon, it increases the stacking fault energy. However, aluminum is a drawback if it is present in excess in steels having a high manganese content, because manganese increases the solubility of nitrogen in liquid iron. If an excessively large amount of aluminum is present in the steel, the nitrogen, which combines with aluminum, precipitates in the form of aluminum nitrides that impede the migration of grain boundaries during hot conversion and very appreciably increases the risk of cracks appearing in continuous casting. In addition, as will be explained later, a sufficient amount of nitrogen must be available in order to form fine precipitates, essentially of carbonitrides. An Al content of 0.050% or less prevents the precipitation of AlN and maintains a sufficient nitrogen content for the precipitation of the elements mentioned below.

Correspondingly, the nitrogen content must be 0.1% or less so as to prevent this precipitation and the formation of volume defects (blisters) during solidification. In addition, when elements capable of precipitating in the form of nitrides, such as vanadium, niobium and titanium, are present, the nitrogen content must not exceed 0.1% for fear of causing coarse precipitation, which is ineffective for hydrogen trapping.

Silicon is also an effective element for deoxidizing steel and for solid-phase hardening. However, above a content of 3%, it reduces the elongation and tends to form undesirable oxides during certain assembly processes, and it must therefore be kept below this limit.

Sulfur and phosphorus are impurities that embrittle the grain boundaries. Their respective contents must not exceed 0.030 and 0.080% so as to maintain sufficient hot ductility.

Optionally, boron may be added in an amount of between 0.0005 and 0.003%. This element segregates at the austenitic grain boundaries and increases their cohesion. Below 0.0005%, this effect is not obtained. Above 0.003%, boron precipitates in the form of borocarbides, and the effect is saturated.

Nickel may be used optionally for increasing the strength of the steel by solution hardening. Nickel contributes to achieving a high elongation at break and in particular increases the toughness. However, it is desirable, again for cost reasons, to limit the nickel content to a maximum content of 1% or less.

Likewise, optionally, an addition of copper with a content not exceeding 5% is one means of hardening the steel by precipitation of copper metal. However, above this content, copper is responsible for the appearance of surface defects in hot-rolled sheet.

Metal elements capable of forming precipitates, such as vanadium, titanium, niobium, chromium and molybdenum, play an important role within the context of the invention. This is because it is known that delayed cracking is caused by an excessive local concentration of hydrogen, in particular at the austenitic grain boundaries. The inventors have demonstrated that certain types of precipitates, the nature, amount, size and distribution of which are precisely defined in the invention, very appreciably reduce the sensitivity to delayed cracking, and do so without degrading the ductility and toughness properties.

The inventors firstly demonstrated that precipitated vanadium, titanium or niobium carbides, nitrides or carbonitrides are very effective as hydrogen traps. Chromium or molybdenum carbides may also fulfill this role. At room temperature, the hydrogen is therefore trapped irreversibly at the interface between these precipitates and the matrix. However, it is necessary, to ensure trapping of the residual hydrogen that might be encountered under certain industrial conditions, for the amount of metal elements in the form of precipitates to be equal to or above a critical content, which depends on the nature of the precipitates. The amount of metal elements in the form of carbide, nitride and carbonitride precipitates is denoted by $V_p$, $Ti_p$ and $Nb_p$ in the case of vanadium, titanium and niobium respectively and by $Cr_p$ and $Mo_p$ in the case of chromium and molybdenum in carbide form.

DETAILED DESCRIPTION OF THE PREFERRED EMBODIMENTS

In this regard, the steel contains one or more metal elements chosen from:

- vanadium, in an amount of between 0.050 and 0.50% by weight, and with the amount in precipitate form $V_p$ between 0.030% and 0.150% by weight.

Preferably, the vanadium content is between 0.070% and 0.40%, the amount $V_p$ being between 0.070% and 0.140% by weight;

- titanium, in an amount Ti of between 0.040 and 0.50% by weight, the amount $Ti_p$ in precipitate form being between 0.030% and 0.130%. Preferably, the titanium content is between 0.060% and 0.40%, the amount $Ti_p$ being between 0.060% and 0.110% by weight;
- niobium, in an amount of between 0.070 and 0.50% by weight, the amount $Nb_p$ in precipitate form being between 0.040 and 0.220%. Preferably, the niobium content is between 0.090% and 0.40%, the amount $Nb_p$ being between 0.090% and 0.200% by weight;
- chromium, in an amount of between 0.070% and 2% by weight, the amount $Cr_p$ in precipitate form being between 0.070% and 0.6%. Preferably, the chromium content is between 0.20% and 1.8%, the amount $Cr_p$ being between 0.20 and 0.5%; and
- molybdenum, in an amount of between 0.14 and 2% by weight, the amount $Mo_p$ in precipitate form being between 0.14 and 0.44%. Preferably, the molybdenum content is between 0.20 and 1.8%, the amount $Mo_p$ being between 0.20 and 0.35%.

The minimum value expressed for these various elements (for example 0.050% in the case of vanadium) corresponds to an amount of addition needed to form precipitates in the manufacturing heat cycles. A preferred minimum content (for example 0.070% in the case of vanadium) is recommended, so as to obtain a higher amount of precipitates.

The maximum value expressed for these various elements (for example 0.50% in the case of vanadium) corresponds to excessive precipitation, or precipitation in an inappropriate form, degrading the mechanical properties, or to an uneconomical implementation of the invention. A preferred maximum content (for example 0.40% in the case of vanadium) is recommended, so as to optimize the addition of the element.

The minimum value of metal elements in precipitate form (for example 0.030% in the case of vanadium) corresponds to the amount of precipitates for very effectively reducing the sensitivity to delayed cracking. A preferred minimum amount (for example 0.070% in the case of vanadium) is recommended, so as to obtain a particularly high resistance to delayed cracking.

The maximum value of metal elements in precipitate form (for example 0.150% in the case of vanadium) marks the deterioration in the ductility or toughness, fracture being initiated on the precipitates. Moreover, above this maximum value, intense precipitation occurs, which may prevent complete recrystallization during continuous annealing heat treatments after cold rolling.

A preferred maximum content in precipitate form (for example 0.140% in the case of vanadium) is recommended, so that the ductility is maintained as far as possible and so that the precipitation obtained is compatible with the recrystallization under the usual recrystallization annealing conditions.

Furthermore, the inventors have demonstrated that an excessively large mean precipitate size reduces the trapping effectiveness. The phrase "mean precipitate size" is understood here to mean the size that can be measured for example using extraction replicas, followed by transmission electron microscope observations: the diameter (in the case of spherical or almost spherical precipitates) or the longest length (in the case of precipitates of irregular shape) of each precipitate is measured and then a size distribution histogram for these precipitates is generated, from which the mean is calculated by counting a statistically representative number of particles. Above a mean size of 25 nanometers, the effectiveness of the hydrogen trapping decreases owing to the reduced interface between the precipitates and the matrix. For a given precipitate amount, a mean precipitate size exceeding 25 nanometers also reduces the density of precipitates that are present, thus excessively increasing the distance between trapping sites. The interfacial area for hydrogen trapping is also reduced. Preferably, the mean precipitate size is less than 20 nanometers so as to trap the largest possible amount of hydrogen.

However, when the mean particle size is less than 5 nanometers, the precipitates will have a tendency to form so as to be coherent with the matrix, thus reducing the trapping capability. The difficulty of controlling these very fine precipitates is also increased. These difficulties are optimally avoided when the mean precipitate size is greater than 7 nanometers. This mean value may include the presence of numerous very fine precipitates, having a size of the order of a nanometer.

The inventors have also demonstrated that the precipitates are advantageously located in intragranular positions so as to reduce the sensitivity to delayed cracking. This is because, when at least 75% of the population of the precipitates lies in intergranular position, the hydrogen possibly present is distributed more uniformly, without accumulation at the austenitic grain boundaries that are potential sites of embrittlement. The addition of one of the aforementioned elements, particularly chromium, allows various carbides to be precipitated, such as MC, $M_7C_3$, $M_{23}C_6$, $M_3C$ where M denotes not only the metal element but also Fe or Mn, these elements being present in the matrix. The presence of iron and manganese within the precipitates increases the amount of precipitates for less cost, thus increasing the effectiveness of the precipitation.

The inventors have also demonstrated that additions of vanadium, this element being precipitated in the form of vanadium carbides VC, vanadium nitrides VN and relatively complex carbonitrides V(CN), are particularly advantageous within the context of the invention.

The object of the invention is specifically to provide steels that have both very high mechanical properties and low sensitivity to delayed fracture. As mentioned above within the context of the manufacture of a cold-rolled and annealed sheet, it is recommended that the steel be completely recrystallized after the annealing cycle. Excessively premature precipitation, taking place for example at the casting, hot-rolling or coiling stage, will have a possible retarding effect on recrystallization and runs the risk of hardening the metal and increasing the hot-rolling or cold-rolling forces. Such precipitation will also be less effective, as it will take place significantly at the austenitic grain boundaries. The size of these precipitates formed at high temperature will be higher, often greater than 25 nanometers.

The inventors have demonstrated that additions of vanadium are particularly desirable insofar as the precipitation of this element hardly takes place during hot rolling or coiling. Consequently, the pre-existing hot-rolling and cold-rolling force settings do not have to be modified and all the vanadium is available for very fine and uniform precipitation during the subsequent annealing cycle after cold rolling. The precipitation takes place in the form of uniformly distributed nanoscale VC and VN or V(CN) precipitates, the great majority of the precipitates being in intragranular positions, that is to say in the form most desirable for hydrogen trapping. In addition, this fine precipitation limits grain growth, a finer size of austenitic grains possibly being obtained after annealing.

The manufacturing process according to the invention is carried out as follows: a steel is smelted that has the following composition: 0.45%≦C≦0.75%; 15%≦Mn≦26%; Si≦3%; Al≦0.050%; S≦0.030; P≦0.080%; N≦0.1%; one or more elements chosen from 0.050%≦V≦0.50%; 0.040%≦Ti≦0.50%; 0.070%≦Nb≦0.50%; 0.070%≦Cr≦2%; 0.14%≦Mo≦2% and, optionally, one or more elements chosen from 0.0005%≦B≦0.003%; Ni≦1%; Cu≦5%, the balance consisting of iron and inevitable impurities arising from the smelting.

This smelting may be followed by the steel being cast into ingots, or cast continuously in the form of slab with a thickness of around 200 mm. The casting may advantageously also be carried out in the form of thin slab, with a thickness of a few tens of millimeters, or thin strip with a thickness of a few millimeters. When certain additional elements according to the invention, such as titanium or niobium, are present, casting the steel in the form of thin products will result more particularly in the precipitation of very fine and thermally stable nitrides or carbonitrides, the presence of which reduces the sensitivity to delayed cracking.

These cast semifinished products are firstly heated to a temperature between 1100 and 1300° C. The purpose of this is to achieve, in every point, temperatures favorable to the high deformations that the steel will undergo during rolling. However, the reheat temperature must not exceed 1300° C. for fear of being too close to the solidus temperature, which could be reached in any regions locally enriched with manganese and/or carbon and of causing the steel to pass locally into the liquid state, which would be deleterious to hot forming. Of course, in the case of direct casting of thin slab, the step of hot-rolling these semifinished products starting between 1300 and 1000° C. could be carried out directly after casting without passing via the intermediate reheat step.

The semifinished product is hot-rolled, for example to obtain a hot-rolled strip thickness of 2 to 5 millimeters in thickness, or even 1 to 5 mm in the case of a semifinished product resulting from casting in thin slab, or 0.5 to 3 mm in the case of casting thin strip. The low aluminum content of the steel according to the invention prevents excessive precipitation of AlN, which would impair the hot deformability during rolling. To avoid any cracking problem through lack of ductility, the end-of-rolling temperature must not be below 890° C.

After rolling, the strip has to be coiled at a temperature such that there is no significant precipitation of carbides, essentially intergranular cementite $(Fe, Mn)_3C$), which would result in a reduction in certain mechanical properties. This is obtained when the coiling temperature is below 580° C. The production conditions will also be chosen in such a way that the product obtained is completely recrystallized.

A subsequent cold-rolling operation followed by annealing may then be carried out. This additional step results in a grain size smaller than that obtained on a hot-rolled strip and therefore results in higher strength properties. Of course, it must be carried out if it is desired to obtain products of smaller thickness, ranging for example from 0.2 mm to a few mm in thickness.

A hot-rolled product obtained by the process described above is cold-rolled after having optionally undergone a prior pickling operation in the usual manner. After this rolling step, the grain is very work-hardened and it is recommended to carry out a recrystallization annealing treatment. This treatment has the effect of restoring the ductility and of obtaining a precipitation according to the invention. This annealing, preferably carried out continuously, comprises the following successive steps:

a heating step, characterized by a heating rate $V_h$;

a soak phase at a temperature $T_s$ for a soak time $t_s$;

a cooling phase at a cooling rate $V_c$; and, optionally, a soak phase at a temperature $T_u$ for a soak time $t_u$.

Before the optional soak phase at the temperature $T_u$, the product may be possibly cooled down to room temperature. This soak phase at the temperature $T_u$ may optionally be carried out in a separate device, for example a furnace for the static annealing of steel coils.

The precise choice of the parameters $V_h$, $T_s$, $t_s$, $V_c$, $T_u$ $t_u$ is usually made in such a way that the desired mechanical properties are obtained, in particular thanks to complete recrystallization. Furthermore, within the context of the invention, a person skilled in the art will adjust them, in particular according to the cold-rolling ratio, in such a way that the amount of metal elements (V, Ti, Nb, Cr, Mo) present in the form of precipitated carbides, nitrides or carbonitrides after annealing lies within the abovementioned contents ($V_p$, $Ti_p$, $Nb_p$, $Cr_p$, $Mo_p$).

A person skilled in the art will also adjust these annealing parameters in such a way that the mean size of these precipitates is between 5 and 25 nanometers, and preferably between 7 and 20 nanometers.

These parameters may also be adjusted in such a way that most of the precipitation takes place uniformly in the matrix, that is to say that at least 75% of the precipitates are in intragranular positions.

In particular, the invention will be advantageously implemented by additions of vanadium. To do this, a steel will be smelted with the following composition: 0.45%≦C≦0.75%; 15%≦Mn≦26%; Si≦3%; Al≦0.050%; S≦0.030%; P≦0.080%; N≦0.1%; 0.050%≦V≦0.50% and, optionally, one or more elements chosen from 0.0005%≦B≦0.003%; Ni≦1%; Cu≦5%. A steel sheet according to the invention is optimally manufactured by casting a semifinished product, heating it to a temperature between 1100 and 1300° C., hot-rolling this semifinished product with an end-of-rolling temperature of 950° C. or higher and then coiling it at a temperature below 500° C.

The sheet is cold-rolled with a reduction ratio greater than 30% (the reduction ratio being defined by (sheet thickness before cold rolling−sheet thickness after cold rolling)/(sheet thickness before cold rolling). The 30% reduction ratio corresponds to a minimum deformation so as to obtain recrystallization. Next, an annealing heat treatment is carried out with a heating rate $V_h$ of between 2 and 10° C./s (preferably between 3 and 7° C./s), at a temperature $T_s$ of between 700 and 870° C. (preferably between 720 and 850° C.) for a time of between 30 and 180 s, the sheet then being cooled at a rate of between 10 and 50° C./s.

This way, a steel is obtained that has a strength of greater than 1000 MPa, with an elongation at break of greater than 50%, and that offers excellent resistance to delayed cracking because of the very fine and uniform precipitation of vanadium carbonitrides.

In the case of Cr or Mo additions according to the invention, it will be advantageous to carry out a temperature soak treatment after the recrystallization annealing, in such a way that the precipitation of nanoscale chromium or molybdenum carbides does not interact with the recrystallization. This treatment may be carried out on continuous annealing installations within an averaging zone immediately following the abovementioned cooling phase. A person skilled in the art will therefore adjust the parameters of this soak phase (soak temperature $T_u$, soak time $t_u$) so as to precipitate chromium and molybdenum carbides according to the invention. It is also possible for this precipitation to take place by subsequently annealing steel in coil form.

By way of nonlimiting example, the following results will show the advantageous characteristics afforded by the invention.

Example

Steels having the composition given in the table below (the compositions expressed in percentages by weight) were smelted. Apart from steels I1 and I2 according to the invention, the table gives for comparison the composition of reference steels. Steel R1 has a very low vanadium content. A cold-rolled steel sheet of steel R2, under the conditions explained below, has too high an amount of precipitates (see Table 2). Steel R3 has an excessive vanadium content.

TABLE 1

Composition of the steels (I1-2 according to the invention and R1-3 for reference)

| Steel | C | Mn | Si | S | P | Al | Cu | Ni | N | B | V |
|---|---|---|---|---|---|---|---|---|---|---|---|
| I1 | 0.635 | 21.79 | 0.01 | 0.003 | 0.007 | 0.005 | <0.002 | <0.01 | 0.003 | <0.0005 | 0.160 |
| I2 | 0.595 | 21.80 | 0.200 | 0.006 | 0.007 | 0.004 | <0.002 | <0.01 | 0.003 | 0.0023 | 0.225 |
| R1 | 0.600 | 21.84 | 0.198 | 0.007 | 0.006 | 0.005 | <0.002 | <0.01 | 0.003 | <0.0005 | 0.013 |
| R2 | 0.625 | 21.65 | 0.01 | 0.003 | 0.007 | 0.005 | <0.002 | <0.01 | 0.003 | <0.0005 | 0.405 |
| R3 | 0.625 | 21.64 | 0.01 | 0.003 | 0.007 | 0.005 | <0.002 | <0.01 | 0.003 | <0.0005 | 0.865 |

Semifinished products from these steels were reheated to 1180° C., hot-rolled with a temperature of 950° C. in order to bring them to a thickness of 3 mm, and then coiled at a temperature of 500° C.

The steel sheets thus obtained were then cold-rolled with a reduction ratio of 50% down to a thickness of 1.5 mm and then annealed under the conditions given in Table 2.

The amount of precipitated metal elements in the form of carbides, nitrides or carbonitrides was determined in these various sheets by chemical extraction and selective dosage. On account of the compositions and the manufacturing conditions, these optional precipitates were based here on vanadium, predominantly vanadium carbonitrides. The amount of vanadium $V_p$ in precipitate form is indicated in Table 2, together with the mean precipitate size measured on the basis of extraction replicas observed using transmission electron microscopy.

TABLE 2

Conditions for annealing after cold rolling; state of precipitation after annealing.

| Steel | $V_h$ (° C./s) | $T_s$ (° C.) | $t_s$ (s) | $V_c$ (° C./s) | Vanadium content V (%) | $V_p$ in precipitate form (%) | Mean precipitate size (nm) |
|---|---|---|---|---|---|---|---|
| I1 | 3° C./s | 825 | 180 | 25° C./s | 0.160 | 0.053 | 17 |
| I2 | 3° C./s | 800 | 180 | 25° C./s | 0.225 | 0.115 | 17 |
| R1 | 3° C./s | 825 | 180 | 25° C./s | 0.013 | 0(*) | — |
| R2 | 3° C./s | 850 | 180 | 25° C./s | 0.405 | 0.219(*) | 15 |
| R3 | 3° C./s | 740 | 120 | 25° C./s | 0.865(*) | nd | nd |

(*)outside the invention

Table 3 shows the mechanical properties in tension: namely strength and elongation at break, obtained under these conditions. Moreover, circular blanks 55 mm in diameter were cut from the cold-rolled and annealed sheets. These blanks were then drawn, by linking-in so as to form flat-bottomed cups (Swift necking tests) using a punch 33 mm in diameter. In this way, the factor β characterizing the severity of the test (i.e. the ratio of the initial blank diameter to the punch diameter) was 1.66. Next, the possible presence of microcracks was checked, either immediately after forming or after waiting for 3 months, thus characterizing any sensitivity to delayed cracking. The results of these observations are also given in Table 3.

TABLE 3

Mechanical properties in tension obtained on cold-rolled and annealed sheets, and drawability and delayed-cracking sensitivity characteristics

| Steel | Strength (MPa) | Elongation at break (%) | Cracks observed after drawing | Cracks observed after waiting for a time of 3 months |
|---|---|---|---|---|
| I1 | 1071 | 55 | No | No |
| I2 | 1090 | 58 | No | No |
| R1 | 1074 | 63 | No | Yes |
| R2 | 1168 | 35 | No | No |
| R3 | 1417 | 28 | n.d. | n.d. |

n.d. not determined

In the case of reference R3, the total vanadium content (0.865%) is excessive and it was impossible to obtain recrystallization even after annealing at 850° C. The elongation properties were therefore greatly insufficient. In the case of steel R2, even though the precipitate size was suitable, vanadium precipitation occurred in excessive amount (0.219% of precipitated vanadium), resulting in deterioration in the elongation at break and insufficient characteristics.

In the case of steel R1, the desired precipitation was absent and sensitivity to delayed fracture was observed.

Steels I1 and I2 according to the invention included precipitates of suitable type and size. More than 75% of them were localized in intragranular positions. These steels combine both excellent mechanical properties (strength greater than 1000 MPa, elongation greater than 55% and high resistance to delayed cracking). The latter property was obtained even without a specific degassing heat treatment.

The hot-rolled or cold-rolled sheets according to the invention are advantageously used in the automotive industry in the form of structural parts, reinforcing elements or external parts which, because of their very high strength and their great ductility, help very effectively in reducing the weight of vehicles while increasing safety in the event of an impact.

The invention claimed is:

1. An iron-carbon-manganese austenitic steel sheet, the chemical composition of which comprises Fe and inevitable impurities and, the contents being expressed by weight:

0.45%≦C≦0.75%
15%≦Mn≦26%
Si≦3%
Al≦0.050%
S≦0.030%
P≦0.080%
N≦0.1%, at least one metal element selected from the group consisting of vanadium, titanium, niobium, chromium and molybdenum, where
0.050%≦V≦0.50%,
0.040%≦Ti≦0.50%,
0.070%≦Nb≦0.50%,
0.070%≦Cr≦2%, and
0.14%≦Mo≦2%, and, optionally, one or more elements selected from the group consisting of
0.0005%≦B≦0.003%
Ni≦1%, and
Cu≦5%, wherein the steel sheet comprises vanadium, the amount of vanadium in the form of precipitated carbides, nitrides or carbonitrides being:
$0.030\% \leqq V_p \leqq 0.150\%$.

2. The steel sheet as claimed in claim 1, wherein the composition of said steel comprises, the content being expressed by weight:
0.50%≦C≦0.70%.

3. The steel sheet as claimed in claim 1, wherein the composition of said steel comprises, the content being expressed by weight:
17%≦Mn≦24%.

4. The steel sheet as claimed in claim 1, wherein the composition of said steel comprises 0.070%≦V≦0.40%, the amount of vanadium in the form of precipitated carbides, nitrides or carbonitrides being:
$0.070\% \leqq V_p \leqq 0.140\%$.

5. The steel sheet as claimed in claim 1, wherein the composition of said steel comprises 0.060%≦Ti≦0.40%, the amount of titanium in the form of precipitated carbides, nitrides or carbonitrides being:
$0.060\% \leqq Ti_p \leqq 0.110\%$.

6. The steel sheet as claimed in claim 1, wherein the composition of said steel comprises 0.090%≦Nb≦0.40%, the amount of niobium in the form of precipitated carbides, nitrides or carbonitrides being:
$0.090\% \leqq Nb_p \leqq 0.200\%$.

7. The steel sheet as claimed in claim 1, wherein the composition of said steel comprises 0.20%≦Cr≦1.8%, the amount of chromium in the form of precipitated carbides being:
$0.20\% \leqq Cr_p \leqq 0.5\%$.

8. The steel sheet as claimed in claim 1, wherein the composition of said steel comprises 0.20%≦Mo≦1.8%, the amount of molybdenum in the form of precipitated carbides being:
$0.20\% \leqq Mo_p \leqq 0.35\%$.

9. The steel sheet as claimed in claim 1, wherein the mean size of said precipitates is between 5 and 25 nanometers.

10. The steel sheet as claimed in claim 1, wherein the mean size of said precipitates is between 7 and 20 nanometers.

11. The steel sheet as claimed in claim 1, wherein at least 75% of the population of said precipitates lies in an intragranular position.

12. A process for manufacturing a cold-rolled sheet made of an iron-carbon-manganese austenitic steel, wherein the chemical composition of the steel comprises, the contents being expressed by weight:

0.45%≦C≦0.75%
15%≦Mn≦26%
Si≦3%
Al≦0.050%
S≦0.030%
P≦0.080%
N≦0.1%, at least one metal element chosen from vanadium, titanium, niobium, chromium and molybdenum, where
0.050%≦V≦0.50%
0.040%≦Ti≦0.50%
0.070%≦Nb≦0.50%
0.070%≦Cr≦2%
0.14%≦Mo≦2%, and, optionally, one or more elements chosen from
0.0005%≦B≦0.003%
Ni≦1%
Cu≦5%, the balance of the composition consisting of iron and inevitable impurities resulting from the smelting, is supplied;

the process comprises the steps of:
- a semifinished product is cast from this steel;
- said semifinished product is heated to a temperature of between 1100 and 1300° C.;
- said semifinished product is hot-rolled with an end-of-rolling temperature of 890° C. or higher;
- said sheet is coiled at a temperature below 580° C.;
- said sheet is cold-rolled; and
- said sheet is subjected to an annealing heat treatment, said heat treatment comprising a heating phase at a heating rate $V_h$, a soak phase at a temperature $T_s$ for a soak time $t_s$, followed by a cooling phase at a cooling rate $V_c$, optionally followed by a soak phase at a temperature $T_u$ for a soak time $t_u$, the steel sheet comprising vanadium and the parameters Vh, Ts, tz, Vc, tu being adjusted in order to obtain the amount of vanadium in the form of precipitated carbides, nitrides or carbonitrides as claimed in claim 1; and obtaining the cold-rolled sheet.

13. The process as claimed in claim 12, wherein the parameters $V_h$, $T_s$, $t_z$, $V_c$, $T_u$, $t_v$, are adjusted in such a way that the mean size of said carbide, nitride or carbonitride precipitates after said annealing is between 5 and 25 nanometers.

14. The process as claimed claim 12, wherein the parameters $V_h$, $T_s$, $t_s$, $V_c$, $T_u$, $t_u$ are adjusted in such a way that the mean size of said precipitates after said annealing is between 7 and 20 nanometers.

15. The process as claimed in claim 12, wherein the parameters $V_h$, $T_s$, $t_s$, $V_c$, $T_u$, $t_u$ are adjusted in such a way that at least 75% of the population of said precipitates after said annealing lies in an intergranular position.

16. The process for manufacturing the cold-rolled iron-carbon-manganese steel sheet as claimed in claim 12, wherein the steel whose chemical composition includes $0.050\% \leqq V \leqq 0.50\%$ is provided, wherein said semifinished product is hot-rolled with an end-of-rolling temperature of 950° C. or higher, wherein said sheet is coiled at a temperature below 500° C., wherein said sheet is cold-rolled with a reduction ratio of greater than 30%, wherein an annealing heat treatment is carried out with a heating rate $V_h$ of between 2 and 10° C./s, at a temperature $T_s$ of between 700 and 870° C. for a time of between 30 and 180 s, and wherein said sheet is cooled at a rate of between 10 and 50° C./s.

17. The process for manufacturing the cold-rolled sheet as claimed in claim 16, wherein the heating rate $V_h$ is between 3 and 7° C./s.

18. The process for manufacturing a cold-rolled sheet as claimed in claim 16, wherein the soak temperature $T_s$ is between 720 and 850° C.

19. The manufacturing process as claimed in claim 12, wherein said semifinished product is cast in the form of slabs or thin strips between counterrotating steel rolls.

20. A method of manufacturing structural parts, reinforcing parts or external parts, comprising forming the structural parts, reinforcing parts or external parts, from the iron-carbon-manganese austenitic steel sheets according to claim 1.

21. The steel sheet according to claim 1, wherein the steel has an elongation at break of greater than 55% and a high resistance to delayed cracking wherein no crack is observed immediately after drawing and for three months after the drawing.

* * * * *